US006414596B1

(12) United States Patent
Altwasser et al.

(10) Patent No.: US 6,414,596 B1
(45) Date of Patent: Jul. 2, 2002

(54) SECURITY DEVICE FOR ELECTRONIC SURVEILLANCE OF ARTICLES

(75) Inventors: Richard Altwasser, Forst (DE); Peter Lendering, Terborg (NL)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/284,954

(22) PCT Filed: Oct. 29, 1997

(86) PCT No.: PCT/EP97/05975

§ 371 (c)(1),
(2), (4) Date: May 4, 1999

(87) PCT Pub. No.: WO98/20371

PCT Pub. Date: May 14, 1998

(30) Foreign Application Priority Data

Nov. 4, 1996 (DE) ..... 196 45 330
Feb. 28, 1997 (DE) ..... 197 08 180

(51) Int. Cl.[7] ..... G08B 13/14

(52) U.S. Cl. ..... 340/572.1; 340/572.8; 156/51; 156/52

(58) Field of Search ..... 340/572.1, 572.2, 340/572.4, 572.5, 572.7, 572.8, 571, 825.54, 568.1; 343/895; 156/51, 52, 324, 250, 234, 239

(56) References Cited

U.S. PATENT DOCUMENTS 4,694,283 A * 9/1987 Reeb ..... 340/572.1
4,745,401 A * 5/1988 Montean ..... 340/572.1
4,778,552 A * 10/1988 Benge et al. ..... 156/272.2
4,792,790 A 12/1988 Reeb ..... 340/572.1
4,818,312 A 4/1989 Benge ..... 156/52
4,846,922 A * 7/1989 Benge et al. ..... 156/324
5,059,950 A * 10/1991 Perchak ..... 340/572.1
5,142,270 A * 8/1992 Appalucci et al. ..... 340/572.1
5,241,299 A 8/1993 Appalucci et al. ..... 340/572.1
5,751,256 A * 5/1998 McDonough et al. ..... 343/873
5,781,110 A * 7/1998 Habeger, Jr. et al. .... 340/572.1
5,902,437 A * 5/1999 McDonough et al. ..... 156/234
6,018,298 A * 1/2000 Endo et al. ..... 340/572.5

FOREIGN PATENT DOCUMENTS

EP 0665705 A2 8/1995

* cited by examiner

*Primary Examiner*—Daniel J. Wu
*Assistant Examiner*—Toan Pham
(74) *Attorney, Agent, or Firm*—Jones, Tullar & Cooper, P.C.

(57) ABSTRACT

The present invention relates to a security element for electronic article surveillance, comprising two at least partially overlapping layers of conductor strips interconnected by a dielectric adhesive coating. This arrangement reduces the risk of reactivation after activation is once effected. To achieve this, the upper layer and the lower layer of conductor strips have at least one turn, and that the strength of the two layers of overlapping conductor strips is so high as to cause the security element to bend, if subjected to mechanical strain, in those areas which are essentially devoid of conductor strips.

16 Claims, 2 Drawing Sheets

FIG. 1
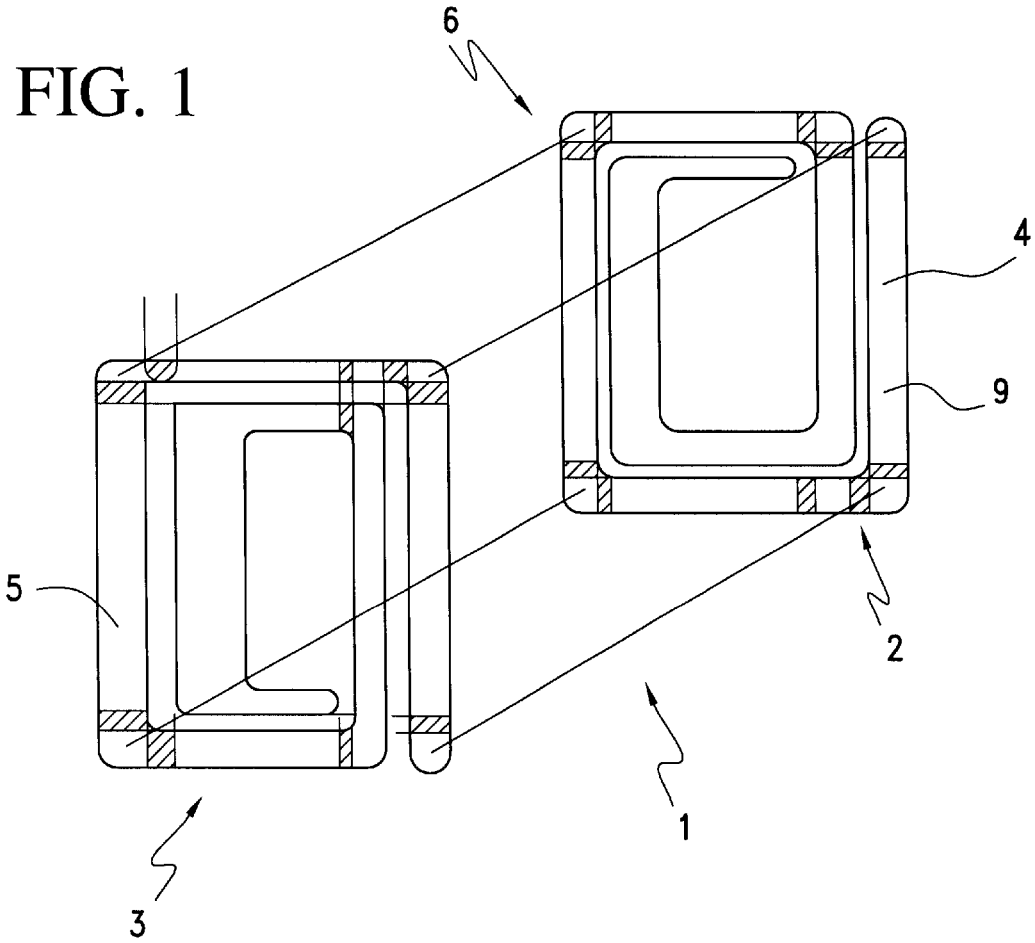
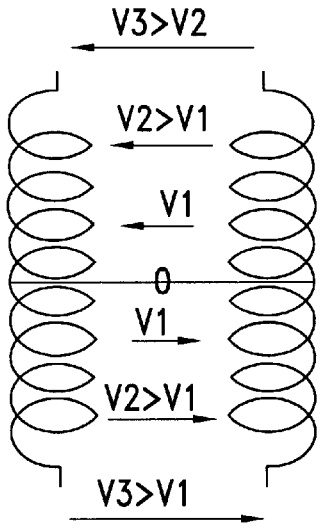
FIG. 2

SECURITY DEVICE FOR ELECTRONIC SURVEILLANCE OF ARTICLES

FIELD OF THE INVENTION

This invention relates to a security element for electronic article surveillance, comprising two at least partially overlapping layers of conductor strips interconnected by a dielectric coating. This dielectric coating can be a dielectric adhesive coating or a dielectric film. At least one of the two conductor strips can also have the dielectric adhesive coating laminated thereto.

BACKGROUND OF THE INVENTION

Security elements in the form of so-called resonant circuit labels or tags are being used increasingly in the prevention and detection of theft in department stores and warehouses. Surveillance takes place as follows: The resonant circuits are excited by an alternating magnetic field in the interrogation zone of the entrance and exit area of the establishment under surveillance, so that they emit a characteristic detection signal. Once the characteristic signal is detected by the surveillance system, an alarm is produced.

It is particularly advantageous to be able to deactivate the security elements as soon as the protected article has been rightly purchased by a customer. A method that has proven successful in this connection is to apply a pulse of energy of a magnitude sufficient to produce a short-circuit between the two layers of conductor strips through the dielectric coating.

A deactivatable security element and a suitable production method therefor are known in the art from European Patent EP 0 665 705 A2. In the known solution, each of the conductor strip layers is comprised of a multiplicity of turns. The two layers of conductor strips are interconnected by a dielectric, very thin coating of resin. This resin coating has an essentially constant thickness over the entire area of the layers.

Deactivation of the security element takes place in this case, too, by applying a sufficiently high pulse of energy. A short-circuit occurs preferably at several points of the security element and is—in statistical terms—distributed evenly over the entire layer area of the overlapping conductor strips.

While the above described resonant circuit can be deactivated easily and reliably, there is yet a risk of it being reactivated by mechanical strain, particularly bending or twisting—in other words, the short-circuiting can be reversed again by mechanical strain. Reactivation is a highly undesirable effect.

SUMMARY OF THE INVENTION

The object underlying the present invention is to propose a security element which reduces the risk of reactivation after deactivation is once effected.

This object is accomplished in that the upper and the lower layer of conductor strips have at least one turn, and that the strength of the two layers of overlapping conductor strips is so high as to cause the security element to bend, if subjected to mechanical strain, in those areas which are essentially devoid of conductor strips.

As previously described, the probability of a short-circuit occurring in the case of the security element 5 known from, the art is equally high over the entire overlapping surface area of the two layers of conductor strips. Since a random area of the security element will be bent or twisted under a mechanical strain, it follows that there is an accordingly high probability of a short-circuit, which happens to exist in this particular area, being reversed.

In the embodiment of the security element according to the present invention, the risk of the security element being reactivated by subjecting the security element to mechanical strain is restricted from the outset to a relatively small percentage of the overall area of overlapping conductor strip layers. Therefore, reactivation is possible only when the position of the short-circuit happens to be exactly in the narrowly limited bending area. The risk of a security element being reactivated unintentionally is naturally greatly reduced as a result.

The security element of the present invention affords a number of further advantages. By reason of the relatively large width of the conductor strips and the small number of conductor strip turns, production can be greatly simplified and is therefore less costly. An additional advantage results from the fact that the larger width of the conductor strips goes hand in hand with a lower impedance and hence a higher Q-factor of the resonant circuit. A higher Q-factor, on the other hand, means that the sharpness of, the resonant signal is more pronounced, enabling the present invention to also improve the detection rate.

In accordance with an advantageous further aspect of the security element of the present invention, provision is made for that part of the area of the conductor strips subjected to bending in the event of mechanical strain to amount to a maximum of 10% of the total area of the conductor strips. As explained in the foregoing, the smaller the bending area of the two conductor strip layers, the less probability of reactivation.

It has proven expedient for the conductor strips to be wider in predetermined sections than in the remaining sections. The stability of the security element can thus be further enhanced.

In a construction of the security element of the present invention that is low-cost and also facilitates production, provision is made for the conductor strips to be made of aluminum, particularly aluminum foil provided with a dielectric coating.

In accordance with an advantageous further aspect of the security element of the present invention, it is proposed in addition for the conductor strips of the two layers to have the same dimensions, one of the layers being folded and turned through 180° relative to the other layer. This arrangement results in particular in the predetermined bending points becoming even more prominent. Particularly if the two conductor strips are identical but wound in opposing directions.

In a favorable embodiment of the security element of the present invention, provision is made for the two conductor strips to be constructed and electrically interconnected in an area in which the voltage present between the conductor strips is zero or at least reaches a minimum level. The security elements conventionally bear a paper label, which for price or product marking purposes is printed with corresponding information in a printer, for example, a laser printer. By interconnecting the conductor strips electrically, it is ensured that the security elements' physical properties are not affected by the direct voltages occurring in the laser printer. In particular this construction can prevent the security elements from being deactivated accidentally during printing.

In accordance with an advantageous configuration aimed at preventing an accidental deactivation of the security element, provision is made for the area of inter-connection to be configured in the shape of a point that comes to lie where the voltage prevailing between the conductor strips is zero.

Often, however, the presence of tolerances makes it difficult in production to connect the two conductor strips exactly at this particular optimum point. In an alternative configuration provision is made, therefore, for the area to be more extensive. Hence the conductor strips are short-circuited over a greater distance, creating a reliable electrical connection of low resistance between the conductor strips. Advantageously, the two conductor strips are interconnected in one of their end areas, which in circuitry terms results in a series connection of the inductances of the two conductor strips.

An economical way to establish the electrical connection between the two conductor strips is by applying pressure once or several times using, for example, a punch device which may be heated as necessary. A further way to obtain a reliable electrical connection between the two spiral shaped conductor strips is to punch holes through the two opposing conductor strips.

An alternative proposal involves the use of a so-called crimping process, in which a heatable punch equipped with teeth is pressed onto the two layers that are to be interconnected. In yet another option for producing an electrical connection between the two conductor strips the following procedure is proposed: Removal of the dielectric coating from the corresponding area or areas by mechanical or chemical means.

Moreover, it is also possible to treat the two conductor strips in accordance with the previously described options before they are joined together.

According to an advantageous aspect of the security element of the present invention, the security element is used simultaneously for identification of the protected article. An integrated circuit, which is connected to the security element in an electrically conductive fashion, is provided for this purpose. It has proven eminently suitable for the electrically conductive connection to be produced by the application of pressure once or several times, with or without heat input, or by punching a hole. Generally speaking, all the previously mentioned options for contacting the two conductor strips can also be used for establishing contact between the integrated circuit and the security element. A data carrier with integrated circuit is already known, moreover, from European Patent EP 0 682 321 A2.

The present invention will be explained in more detail in the following with reference to the accompanying drawing.

BRIEF DESCRIPTION OF THE DRAWINGS

FIG. 1 is an exploded view of the security element of the present invention;

FIG. 2 is an illustration of the voltage relationships between the two conductor strips;

DESCRIPTION OF THE PREFERRED EMBODIMENTS

Figure 3:
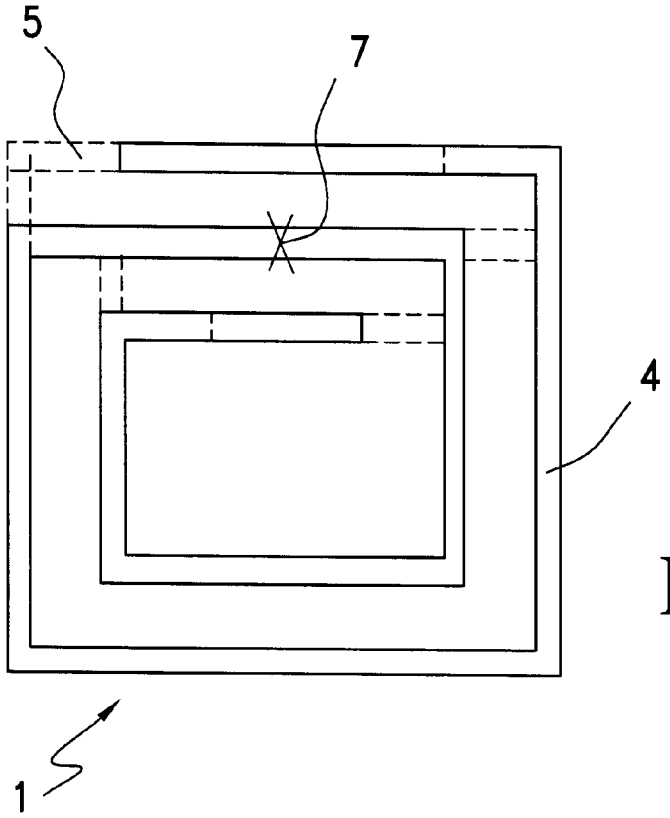
FIG. 3 is a view of an advantageous first embodiment of the security element of the present invention.

FIG. 1 shows an exploded presentation of the security element 1 according to the present invention. The security element 1 is comprised of a lower layer 2 of conductor strips 4 and an upper layer 3 of conductor strips 5. Both layers 2, 3 are nearly identical in their dimensions, but they are turned relative to each other in the manner previously described. It is also possible for the widths of the two layers (2, 3) of conductor strips (4, 5) to differ from each other.

As illustrated clearly by the dashed lines, the security element 1 of the present invention bends under mechanical strain preferably in the areas lying in the direct extension of those areas of the security element 1 that are devoid of conductor strips. Bending of the security element thus affects only the shaded areas of the layers 2, 3 of conductor strips 4, 5. The sum of the corresponding surface areas is small compared to the total area of overlapping conductor strips 4, 5. Considering that the probability of deactivation is equally high over the total area of the overlapping layers 2, 3 of conductor strips 4, 5, only a small fraction of security elements 1 will suffer a short-circuit in the shaded areas. The risk of reactivation under mechanical strain continues to exist therefore only for this small fraction of security elements 1.

FIG. 2 illustrates the different voltage potentials occurring in various areas across the length of the two overlapping conductor strips 4, 5 during electromagnetic induction.

On a security element 1 with a uniform thickness of a dielectric coating 9 between the conductor strips 4, 5, deactivation takes place preferably in the end areas of the upper conductor strip 4 and the lower conductor strip 5 because this is where the induced voltage is at its maximum level. If the conductor strips 4, 5 have the same dimensions but are wound in opposing directions, the voltage potential will vanish completely in the central area between the two conductor strips 4, 5. Consequently, when a deactivation signal is applied, deactivation should take place in the end areas of the two overlapping conductor strips 4, 5.

In statistical terms, deactivation occurs at any random point within the overlapping area, in spite of the above mentioned favorable conditions in the end areas of the two overlapping conductor strips 4, 5. This is because the dielectric coating 9 is not of uniform thickness or contains faults, such as air bubbles. Both irregularities are the result of production errors. Such production errors can cause local points of weakness and, where air inclusions are concerned, even holes in the dielectric coating 9. Hence when the deactivation signal is applied, the dielectric coating 9 breaks down at these local points of weakness as well, although the voltage potential is sometimes substantially lower here than in the end areas of the two conductor strips 4, 5.

FIG. 3 shows a top view of an advantageous first embodiment of the security element 1 of the present invention. The lower conductor strip 5 is only partly visible and drawn in broken lines. According to this embodiment, the two conductor strips 4, 5 are interconnected electrically in the area 7. The voltage potential in this area 7 is minimal or zero. This is an effective way to prevent the security element 1 from being deactivated unintentionally when an external direct voltage is applied, such as happens, for example, when printing the paper label attached to the security element 1 on a printer, particularly a laser printer.

The security element 1 shown in FIG. 3 produces excellent detection rates and best deactivation results only when the electrical connection lies exactly in the area 7 in which the voltage potential between the two conductor strips 4, 5 becomes zero. Hence for a security element 1 of this type, the quality of production has to meet the highest requirements. Fact is, if the electrical connection lies only slightly outside the optimum area 7, there will be a deterioration in the Q-factor and in the resonance amplitude of the security element 1 —ultimately, therefore, in the detection rate of the security element 1.

Figure 4:
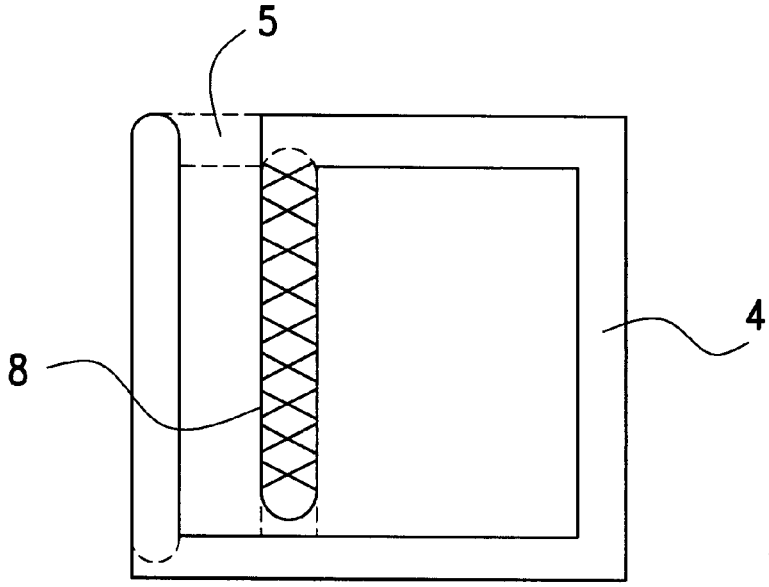
FIG. 4 is a view of an advantageous second embodiment of the security element of the present invention.

This drawback is eliminated by the advantageous second embodiment of the security element 1 of the present invention shown in FIG. 4. In this embodiment the electrical connection by single point contact between the two conductor strips 4, 5 is replaced by a series of electrical connections situated along the area 8. This electrical connection is substantially more reliable therefore than the connection in a point-shaped area 7, and it is most unlikely that it will be broken by mechanical strain on the security element 1. In circuitry terms the electrical connection results in a series connection of the inductances of the upper and lower spiral-shaped conductor strips 4, 5. It should be noted that the security element 1 illustrated in this example has only one turn. This turn is constructed to be of a width sufficient for the predetermined bending points to again lie in those areas in which only one of the conductor strips 4, 5 runs.

What is claimed is:

1. A security element for electronic article surveillance, comprising:

a dielectric adhesive coating; and two at least partially overlapping layers of conductor strips interconnected by said dielectric adhesive coating, wherein each layer has at least one turn and areas devoid of conductor strips, and wherein the strength of said layers of conductor strips is high so as to bend the element in those areas devoid of conductor strips, when subjected to mechanical strain.

2. The security element as defined in claim 1, wherein the maximum area of said conductor strips subjected to bending is 10% of the total area of said conductor strips.

3. The security element as defined in claim 1, wherein said conductor strips are wider in predetermined sections than in the remaining sections.

4. The security element as defined in claim 1, wherein said conductor strips are made of aluminum.

5. The security element as defined in claim 1, wherein said conductor strips are of essentially like dimensions, with one of said layers being folded and turned through 180° relative to said other layer.

6. The security element as defined in claim 1, wherein said conductor strips are wound in opposing directions.

7. The security element as defined in claim 1, wherein said conductor strips are electrically interconnected in an area where the voltage present between said conductor strips is at a minimum level, including zero.

8. The security element as defined in claim 7, wherein said area has a point-shaped configuration.

9. The security element as defined in claim 8, wherein said area is obtained by the application of pressure once or several times.

10. The security element as defined in claim 8, wherein said area is obtained by a punching operation.

11. The security element as defined in claim 1, wherein said conductor strips are electrically interconnected in an area having a certain extent.

12. The security element as defined in claim 11, wherein said area having a certain extent is obtained by the application of pressure once or several times.

13. The security element as defined in claim 11, wherein said area having a certain extent is obtained by a punching operation.

14. The security element as defined in claim 1, further comprising:

an integrated circuit connected to the security element in an electrically conductive fashion.

15. The security element as defined in claim 14, wherein the electrically conducted connection is produced by the application of pressure once or several times; with or without a heat input.

16. The security element as defined in claim 14, wherein the electrically conducted connection is produced by punching a hole.

* * * * *